US006941590B2

(12) United States Patent
Lim

(10) Patent No.: US 6,941,590 B2
(45) Date of Patent: Sep. 13, 2005

(54) TOILET SYSTEM ATTACHED A MULTI-PURPOSE HAND HELD SPRAYER

(76) Inventor: Howard Tak Su Lim, 12210 Rives Ave., Downey, CA (US) 90242

( * ) Notice: Subject to any disclaimer, the term of this patent is extended or adjusted under 35 U.S.C. 154(b) by 271 days.

(21) Appl. No.: 10/751,546

(22) Filed: Jan. 5, 2004

(65) Prior Publication Data

US 2005/0120470 A1 Jun. 9, 2005

Related U.S. Application Data

(63) Continuation-in-part of application No. 10/731,180, filed on Dec. 9, 2003.

(51) Int. Cl.[7] ..... E03D 9/08
(52) U.S. Cl. ..... 4/420.4; 4/443
(58) Field of Search ..... 4/420.1–420.5, 4/443, 445, 447, 448

(56) References Cited

U.S. PATENT DOCUMENTS

| | | | | |
|---|---|---|---|---|
| 2,364,491 A | * | 12/1944 | Triadou | 239/530 |
| 3,995,326 A | | 12/1976 | Umann | |
| 4,000,742 A | | 1/1977 | DiGlacomo | |
| 4,069,519 A | | 1/1978 | Alexander | |
| 4,123,807 A | | 11/1978 | Oguma et al. | |
| 4,127,904 A | | 12/1978 | Junker | |
| 4,135,255 A | | 1/1979 | Menendez | |
| 4,181,985 A | | 1/1980 | Rius | |
| 4,197,594 A | | 4/1980 | Butterfield | |
| 4,205,402 A | | 6/1980 | Miller | |
| 4,207,628 A | | 6/1980 | Ibel | |
| 4,237,560 A | | 12/1980 | Riegelman et al. | |
| 4,242,764 A | | 1/1981 | Fukuda | |
| 4,551,867 A | | 11/1985 | Gurevich et al. | |
| 4,553,274 A | | 11/1985 | Yui | |
| 4,581,779 A | | 4/1986 | Matsui et al. | |
| 4,596,058 A | | 6/1986 | Nourbakhsh | |
| 4,636,474 A | | 1/1987 | Ogura et al. | |
| 4,638,514 A | | 1/1987 | Landsberger | |
| 4,642,820 A | | 2/1987 | Boring, Jr. | |
| 4,807,311 A | | 2/1989 | Ingels | |
| 4,924,534 A | | 5/1990 | Basile | |
| 4,926,509 A | | 5/1990 | Bass | |
| 4,955,121 A | * | 9/1990 | Sato et al. | 29/888.2 |
| 4,967,423 A | | 11/1990 | Aoyama | |
| 4,998,300 A | | 3/1991 | Sharifzadeh | |
| 5,025,510 A | | 6/1991 | Basile | |
| 5,063,618 A | * | 11/1991 | Souka | 4/420.4 |
| 5,090,067 A | | 2/1992 | Cogdill | |
| 5,138,726 A | | 8/1992 | Campbell | |
| 5,142,711 A | | 9/1992 | Parikh | |
| 5,203,037 A | | 4/1993 | Kang | |
| 5,247,711 A | | 9/1993 | Kwon | |
| 5,263,205 A | | 11/1993 | Leunissen | |
| 5,271,104 A | | 12/1993 | LaTora | |
| 5,272,774 A | | 12/1993 | Ivko et al. | |
| 5,279,001 A | | 1/1994 | Vento | |

(Continued)

*Primary Examiner*—Gene Mancene
*Assistant Examiner*—Huyen Le

(57) ABSTRACT

An improved toilet system affording upgraded hygienic environment by attachment of a multi-purpose hand held sprayer and addition of new features on the existing toilet system are provided. The multi-purpose hand held sprayer that incorporates a manual shut-off valve delivers various patterns of water spray via an extension bar and a spray tip, which further employs a flexible hose, a valve to regulate the flow, a Y-adapter assembly to supply water from an existing plumbing fixture, a hose hanger mounted on the existing toilet fasteners, a holder for placing the sprayer, and a holder for placing lavatory items. The new features include an improved toilet seat having an additional opening with guidelines and an embedded fortifying element at the frontal area for facilitating placement of the sprayer, a toilet bowl having the same guidelines, and an improved water tank together with its lid having cutouts at the edges and holes on the side wall for mounting the holders.

17 Claims, 6 Drawing Sheets

U.S. PATENT DOCUMENTS 5,359,736 A 11/1994 Olivier
5,384,919 A 1/1995 Smith
5,452,483 A 9/1995 Dizon
5,566,402 A 10/1996 Agha el-Rifai et al.
5,720,055 A 2/1998 Krist
5,809,585 A 9/1998 Farshad
5,884,345 A 3/1999 Sugiyama et al.
5,911,516 A 6/1999 Chang
5,933,881 A 8/1999 Smith
5,937,451 A 8/1999 Mihara
5,953,766 A 9/1999 Szoke
5,991,937 A 11/1999 Safara
6,073,275 A 6/2000 Klopocinski
6,105,179 A 8/2000 Burns
6,178,568 B1 1/2001 Boulieris
6,192,527 B1 2/2001 Paul
6,321,396 B1 11/2001 Vallejo
6,357,057 B1 * 3/2002 Krist ..... 4/420.4
6,397,406 B1 6/2002 Moshkovich
6,473,913 B1 11/2002 Bell, Sr.
6,487,732 B1 12/2002 Smith
6,618,865 B1 9/2003 Kim
6,643,856 B2 11/2003 Valverde
6,665,888 B1 12/2003 Kwak

* cited by examiner

TOILET SYSTEM ATTACHED A MULTI-PURPOSE HAND HELD SPRAYER

RELATED APPLICATIONS

This application is continuation-in-part (CIP) of prior U.S. patent application Ser. No. 10/731,180 applied on Dec. 9, 2003, which is fully incorporated herein.

BACKGROUND OF THE INVENTION

1. Field of Invention

This invention relates to an improved toilet system attached a multi-purpose hand held water spraying apparatus, engaging in delivering instant water supply for hygienic and cleaning purposes.

2. Description of Related Art

People often desire to obtain a device that may clean their toilet systems and its surrounding areas. At times people may need a device to cleanse soiled areas of their body. My invention is equally beneficial for both needs. The improved toilet system is designed for the cleansing of the user's body as well as cleaning the toilet fixture using an attached multi-purpose hand held sprayer, creating better hygienic environment. Devices invented for these purposes are presented in the previous arts, but not easily found in the current market. The lacks of practicality and marketability hinder the devices from their production for the consumers.

As for the function of cleaning the user's body, there are many competitors in the market that offer personal hygiene devices. One available system is called bidet, but it requires an additional bowl in the bathroom and costs are high for installation. The majority of the other bidet related inventions have sprayers added to the existing toilet systems. The spray nozzles are placed around the toilet in permanent methods, having some drawbacks. Because of the immobility of the sprayer nozzle, some of them require the user to maintain a specific body alignment to obtain better cleansing. Moreover, many devices have need of frequent sanitization because the nozzles stay inside the bowl when used. This invention offers mobility of spraying functions by the user's choice of insertion and operation, not requiring a specific body alignment and frequent sanitization of the device.

The function of cleaning the toilet system adds better cleaning environment to the conventional toilet systems. The conventional toilet systems have predetermined water flush passages in the toilet bowl. These flush passages are designed for transporting water into the toilet bowl from a toilet water tank by means of the gravity forces. Therefore, the bowl structure having predetermined water passages restricts the area to be cleaned, and the limited gravity force is frequently not enough to clean the soiled bowl. This invention assists to get over these obstacles by addition of the mobile hand held water sprayer, helping the user for frequent cleaning of soiled bowl and its vicinity.

The functions of cleaning the toilet system and the user's body are available in some of the inventions related to the attachments for toilets. A device such as U.S. Pat. No. 6,473,913 to Bell, Sr. discloses a bidet attachment for a toilet having an S nozzle connected to the water hose. A stream outlet valve and a sprayer valve selectively control water flow to the stream outlet and sprayer, respectively. This invention implements a water housing to supply water to the device. A device such as U.S. Pat. No. 5,720,055 to Krist discloses a cleaning and hygienic sprayer. This can be used as a bidet or a cleansing device and a device for cleaning clogged toilets and drains. A spray head is secured at an acute angel in relation to a longitudinal axis of a rigid handle and a secondary unit is independently connected to a water supply for delivery of water to a hand-held spray nozzle.

However, this invention overcomes many of the drawbacks in other systems, adding more benefits to the conventional toilet system. The current invention implements an easily attachable Y-adaptor to supply water to the system. It adopts a single unit sprayer incorporating a single shut-off valve to simplify the structures of device. Its installation does not take a large space nor require complicated knowledge for the general public. Its components are oriented for heavy duty, accomplishing durable usages for longer time with less frequent maintenances. The systematic structures of this invention are in favor of manufacturing in the industry as well as accommodating in the household. Its external designs and colors are selective to enhance the aesthetic beauties of the toilet system.

SUMMARY OF THE INVENTION

The present invention provides an improved toilet system attached a multi-purpose hand held sprayer. The multi-purpose hand held sprayer, namely a "sprayer", overcomes the drawbacks pertained in the prior arts to achieve a single stream and a multiple streams of water for various usages. The addition of new features to the conventional toilet systems facilitates the user to operate the sprayer. The lengthy sprayer delivers water to a remote area such as a central part of toilet bowl. Its slim body allows the user to place through a limited space while the user sitting on the toilet seat. A single stream of water can be useful for cleaning the toilet bowl and a multiple streams of spray can be utilized for cleansing a part of the user's body as a bidet purpose.

The sprayer comprises three components assembled by means of quick connection: a controller, an extension bar, and a spray tip. The controller incorporates a shut-off valve to get instant access of water supply. Its body has a contour for placing in a holder with higher position. The extension bar in communication with the sprayer extents the water to its outlet delivering a single stream for cleaning the toilet system and its vicinity. Its body also has a contour for placing in a holder with lower position. The extension bar contains location points at measured increment aligned on the back as guidelines to facilitate placing the sprayer into the toilet bowl. The spray tip connected to the extension bar has a plug containing multiple holes to deliver various water spraying patterns. Its angled body allows the user to achieve a proper direction of spray when it is used for a bidet.

A holder for the sprayer is mounted to a side surface on the top edge of the existing water tank. The holder includes a body to place the sprayer and a reversed U-type bracket to hold the body. The body can be placed on the surface using fasteners or an adhesive without a bracket. It also utilizes the reversed U-type bracket to be mounted on the side surface of the water tank. The bracket is placed on the top edge of the water tank and secured by a multiple fasteners above the water level. A holder for lavatory items can be placed on any available surface to place a cleansing agent or any medicine to improve the environment of toilet system. This bolder has an I-shape bracket, as an example of another type of bracket, to mount on the topside of toilet water tank with fasteners using holes on the body.

An outlet of the flexible hose is coupled to the inlet of the sprayer to extend its operation range. Besides, a hose hanger is placed for organization of the flexible hose by utilizing the existing fasteners of the toilet system. The hose hanger has a main rod for placing the hose and a supporting rod to secure. It has an opening to secure tightly a part of the hose and an opening to loosely place the rest part of the hose. An inlet of the flexible hose is coupled to the outlet of a valve. The valve regulates the flow of water through the system. An inlet of the valve is then coupled to a Y-adapter assembly that has an inlet, two outlets, a straight nipple, an angled nipple and a bushing. The inlet is coupled with the existing water supply plumbing fixture through a bushing. The first of the two outlets is connected to the existing water supply line for the toilet water tank via a straight nipple. The second of the two outlets is connected to the inlet of valve via an angled nipple to supply water to the sprayer.

One of the features improved on the existing toilet system is a toilet seat. The improved toilet seat has an extra small opening at the front adjoining to the existing large opening. It also has a multiple bulging lines on the surface of the frontal area parallel to the edge of the small opening. The bulging lines can be implemented on the surface of toilet bowl at the frontal area, if the toilet seat has a formation of an open end. These extra small opening and the bulging lines on the surface at frontal area facilitate for placing the sprayer into the toilet bowl as guidelines while the user is sitting on the toilet seat. Other features improved on the existing toilet system are cutouts on the edges of toilet water tank and its lid. The cutouts allow the bracket of holder for flush mounting wherein the lid sits on the top of the toilet water tank without lifting or other displacement. The bracket of the holder can adopt a multiple holes on the side of toilet water tank for mounting with fasteners.

It is therefore an object of the present invention to provide an improved toilet system that has a multi-purpose hand held sprayer attached to the conventional toilet system, wherein the sprayer has all the advantages over the previous arts for a personal hygiene.

It is another object of the present invention to provide an improved toilet system that has a multi-purpose hand held sprayer attached to the conventional toilet system, wherein the sprayer overcomes the drawbacks of the previous arts for cleaning the toilet system itself and the vicinity.

It is a further object of the present invention to provide an improved toilet system that has a multi-purpose hand held sprayer attached to the conventional toilet system, wherein the improved toilet system contains new additional features for facilitating to use the sprayer.

It is an even further object of the present invention to provide an improved toilet system that has a multi-purpose hand held sprayer attached to the conventional toilet system, wherein the present invention can be easily connected to the existing plumbing fixtures without interrupting the flow of main water supply line.

It is still another object of the present invention to provide an improved toilet system that has a multi-purpose hand held sprayer attached to the conventional toilet system, wherein the present invention can be built with low costs and manufactured with the enhanced outlooks of existing toilet system by pursuing conformity of its pattern, color, and style.

DESCRIPTION OF THE PREFERRED EMBODIMENTS

Figure 1:
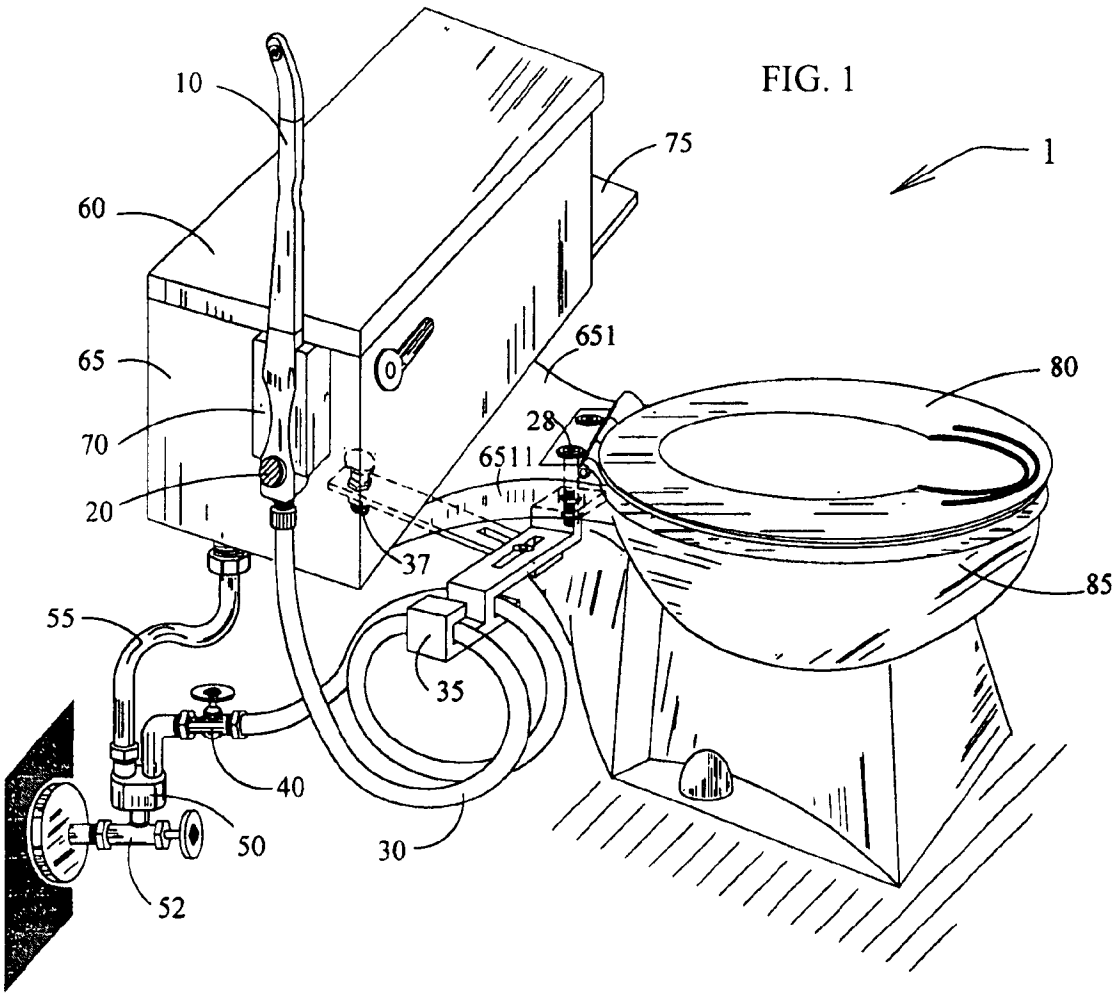
FIG. 1 is a perspective view showing an improved toilet system attached a multi-purpose hand held sprayer to the existing plumbing fixtures.

Reference is now made in detail to the present invention, examples of which are illustrated in the accompanying drawings wherein reference numerals having the same first two digits indicate related elements, such as 10 and 101. The numerals having the same first three digits indicate same components with different elements, such as 101 and 1015. General structures of the invention will be described following by details and the function of components. Referring to FIG. 1, a perspective view of the present invention, an improved toilet system attached a multi-purpose hand held sprayer, or namely a "improved toilet system", is shown and indicated by the number 1. The improved toilet system is composed of a multi-purpose hand held sprayer 10, or that is a "sprayer"; a shut-off valve 20; a holder 70 for the sprayer; a holder for lavatory items 75; a flexible hose 30; a hose hanger 35 for the flexible hose 30; a valve 40 for regulate the flow of water, a Y-adapter assembly to tap water from the existing plumbing fixture; a water tank lid having a cutout 60 for flush mounting of the holder, a water tank having a cutout 65 as well as holes for mounting of the holders; an improved toilet seat 80; a improved toilet bowl 85. The durable structures of the components are added to obtain practicality and the design is pursuing conformity to the existing toilet system for enhancing aesthetic beauty. More details are in the following with fill descriptions.

Figure 2:
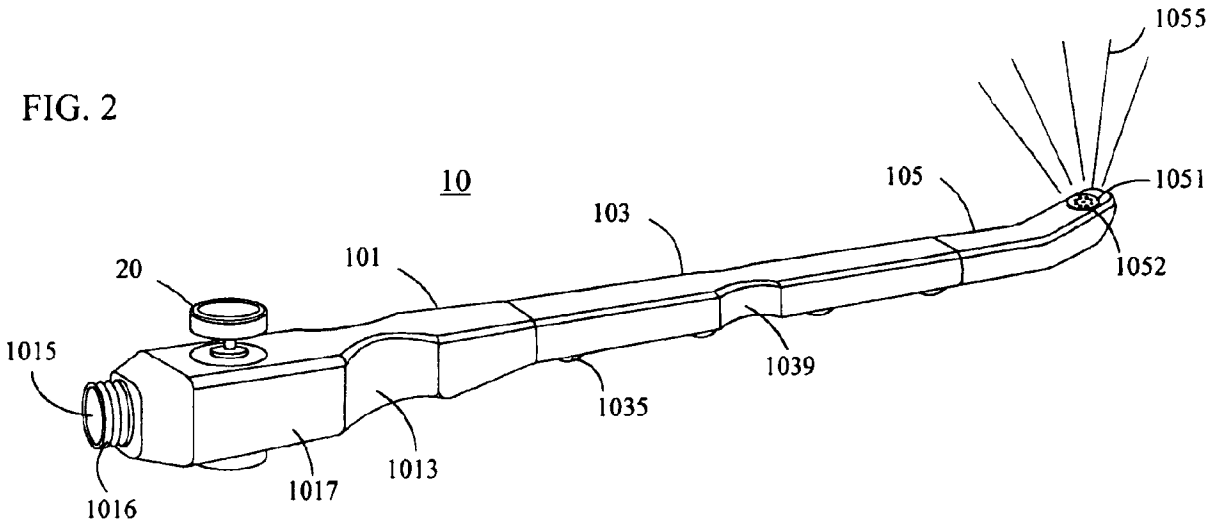
FIG. 2 is a perspective view of a multi-purpose hand held sprayer, wherein the sprayer has a multiple streams of water sprayed from a plug of the angled spray tip.
Figure 3:
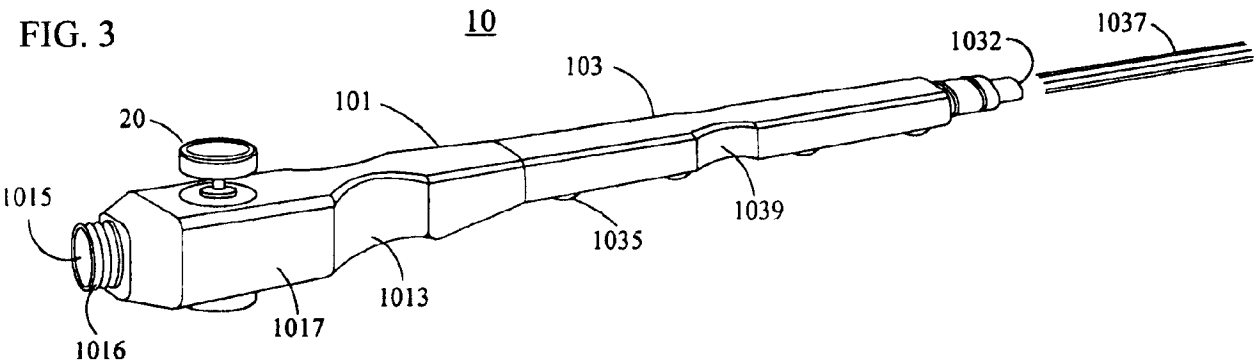
FIG. 3 is a perspective view of a multi-purpose hand held sprayer, wherein the sprayer has a single stream spouted from the end of extension bar.

The sprayer 10 in FIG. 2 comprises a controller 101, an extension bar 103, and a spray tip 105. The controller 101 incorporates a shut-off valve 20 to regulate the flow of water received from a pressurized inlet 1015. Its body 1017 takes a slim and lengthy shape (approximately 1" Width×1" Height×5" Length) and contains a contour 1013 for placing in the holder with higher position. The higher position requires more room of the upper area for the sprayer to be placed in the holder. A coupling element 1016 on the body 1017 is placed to connect to a flexible hose. The body 1017 is further connected to the extension bar 103 to transport water to remote area. The extension bar 103 contains a contour 1039 for placing in the holder with lower position. The lower position requires less room of the upper area for the sprayer to be placed in the holder. This position is necessary when the upper area between a toilet water tank and an object such as a shelf located above has not enough room for the sprayer to be placed in the holder. The extension bar 103 in FIG. 2 contains location points 1035 aligned on the back as guidelines to facilitate placing the sprayer into the toilet bowl. It takes a slim and lengthy shape for easy placement through a limited opening. Its length is adjusted to obtain the proper application. The outlet 1032 of the extension bar 103 supplies a single solid stream 1037 of water as shown in FIG. 3. Its strong spouting water stream 1037 in FIG. 3 can be utilized to clean the toilet bowl and its vicinity. The extension bar 103 in FIG. 2 is furthermore connected to the spray tip 105 to provide various patterns of water supply. A plug 1051 on the spray tip 105 has small openings 1052 to provide multiple streams 1055 of water as shown in FIG. 2. These multiple streams 1055 of water can be utilized for cleansing the body, serving as a bidet. Its angled body accommodates a proper direction to supply water to the user in the toilet bowl. The body of the spray tip takes a slim shape to be easily placed into the toilet bowl through a limited opening at the frontal area.

Figure 4:
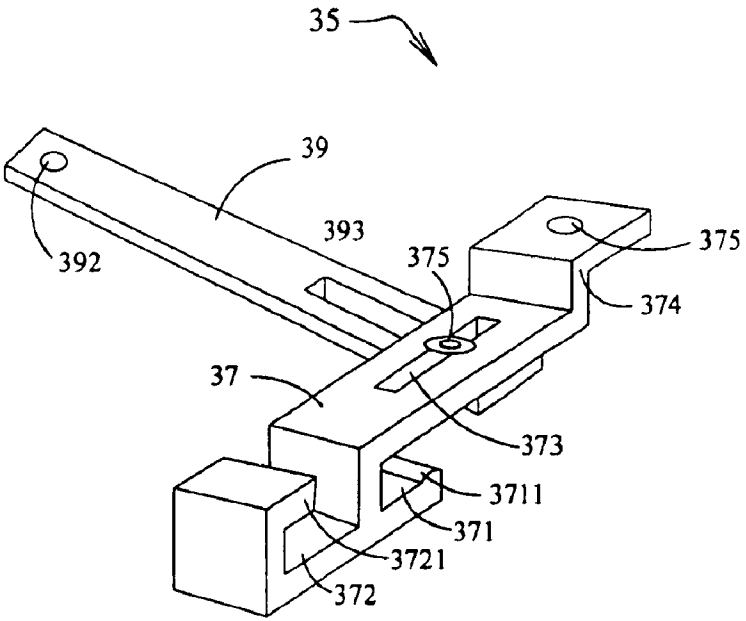
FIG. 4 is a perspective view of a hose hanger having a main rod and its supporting rod with lengthy slot holes joined by a fastener.

The controller 101 in FIG. 2 has a coupler 1016 at the inlet 1015 to connect to a flexible hose 30 in FIG. 1. The flexible hose 30 is long enough to clean a part of the body and the surrounding area. It has a hose hanger 35 in FIG. 4 for arrangement in the openings 371, 372 of main rod 37. One opening 371 in FIG. 4 is a fixed hanging section under the main rod 37. It holds and fixes a part of the hose from the bottom. A lip 3711 on the opening 371 catches the hose 30 and does not allow the hose slipped out easily. This opening 371 is good for hanging the hose 30 immediately after the valve 40 as shown in FIG. 1, immobilizing a certain part of the hose 30. The other opening 372 in FIG. 4 is for a free hanging section upwardly to facilitate placing of the rest part of the loosened hose 30. A stopper 3721 in the opening 372 helps to keep the flexible hose in the place. A small hole 375 in FIG. 4 is for attaching the hose hanger 35 to an existing toilet seat fasteners 28 in FIG. 1 of the toilet system. Because the fasteners are generally bolts and nuts, the hose hanger can be easily attached by addition of another bolt after being inserted through the hole 375. Some of the toilet systems have an edge 6511 in FIG. 1 protruded under the water tank base 651 around the fasteners 28. To get over this protruded edge 6511 in FIG. 1, the hose hanger 35 in FIG. 4 requires an angled extension part 374. The hose hanger 35 can be more stabilized with the main rod 37 attached a supporting rod 39 in FIG. 4. The supporting rod 39 has a hole 392 for attachment to a fastener 37 in FIG. 1 of the water tank 60. A lengthy slot 373 on the main rod 37 together with a lengthy slot 393 on the supporting rod 39 can be placed for joining them with a fastener 375. These lengthy slots 373, 393 are useful for mounting the hose hanger 35 to the various sizes of toilet systems, because they allow to adjust the distances between the opening 375 of the main rod 37 and the opening 392 of the supporting rod 39.

Figure 5:
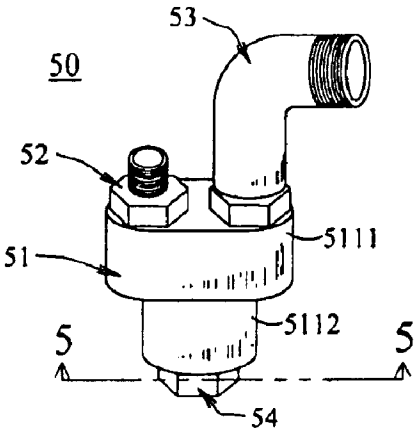
FIG. 5 is a perspective view of a Y-adapter assembly containing a main body, a bushing at the inlet, a straight nipple at the first outlet, and an angled nipple at the second outlet.
Figure 5A:
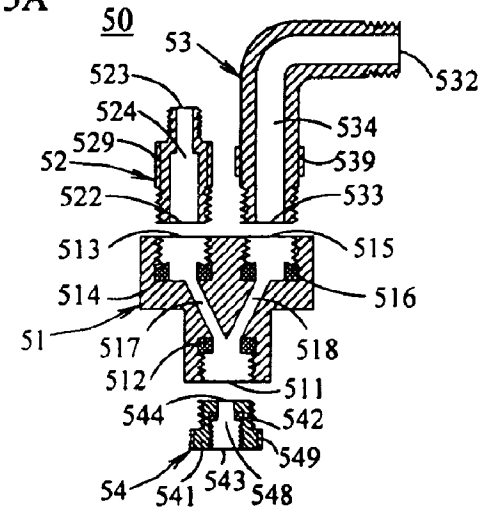
FIG. 5A is a cross-sectional view taken on the line 5—5 of FIG. 5, showing the internal structures of components with an exploded view.

The hose 30 in FIG. 1 is further connected to a valve 40 to regulate the flow of water. This valve is necessary for the time that the sprayer has failure for proper operation or requires flow of water to be adjusted. The valve is furthermore connected to a Y-adapter 50 to tap water from the existing plumbing fixture 52, as shown in FIG. 1. The Y-adapter 50 in FIG. 5, named from the shape of internal channel, comprises a main body 51, a straight nipple 52, an angled nipple 53, and a bushing 54. The main body 51 in FIG. 5A has an inlet 511 with a washer 512, the first outlet 513 with a washer 514, the second outlet 515 with a washer 516, the first internal channel 517 connected from the inlet 511 to the first outlet 513, and the second internal channel 518 connected from the inlet 511 to the second outlet 515. The straight nipple 52 in FIG 5A has an inlet 522 for coupling to the first outlet 513 of the main body 51, outlet 523 for coupling to an existing water supply line 55 in FIG. 1, and an internal channel 524 connecting the inlet 522 to the outlet 523. This straight nipple 52 is necessary for the existing water supply line 55 in FIG. 1 having various sizes of couplings. The angled nipple 53 in FIG. 5A has an inlet 533 for coupling to the second outlet 515 of the main body 51, an outlet 532 for coupling to the valve 40 in FIG. 1, and an internal channel connecting the inlet 533 to the outlet 532. The outlet 532 of the angled nipple 53 is adjusted toward the frontal or any convenient direction. However, the nipples can take any angles of body for facilitating connections. The bushing 541 in FIG. 5A comprises an inlet 543 to couple to the existing plumbing fixture 52 in FIG. 1, an outlet 544 to couple to the inlet 511 of main body 51, an internal channel 548 to connect the inlet 543 to an outlet 544, a washer 542 to seal. This bushing is also necessary for the existing plumbing fixture 52 in FIG. 1 having various sizes of couplings. Various sizes of plumbing fixtures 52 in FIG. 1 require their matching nipples 52 as well as bushings for coupling, allowing the Y-adapter having one size of couplers for the inlet 511 and the outlets 513, 515.

Figure 6:
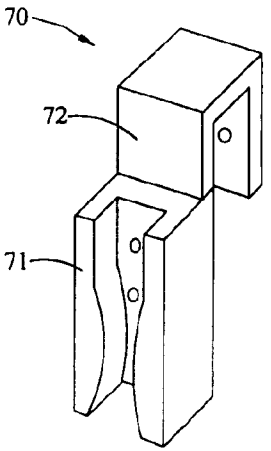
FIG. 6 is a perspective view of the holder for the sprayer comprising a body for placing the sprayer and a bracket for placing onto a top edge of water tank.
Figure 6A:
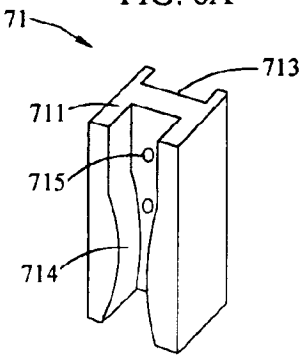
FIG. 6A is a perspective view of the body of the holder for the sprayer.
Figure 6B:
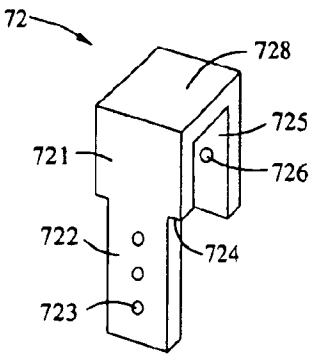
FIG. 6B is a perspective view of a reversed U-type of bracket for the holder.

A holder 70 for the sprayer in FIG. 6 comprises a holder body 71 and a bracket 72. The holder body 71 in FIG. 6A has a body 711 that contains an opening 713 for attaching the reversed U-type bracket 72, an opening 714 for placing the sprayer 10 in FIG. 2, and holes 715 for fasteners to secure. The opening 714 has the same contour 1013 as the body 1017 of the sprayer 10 in FIG. 2 for placing. The holes 715 are located for fasteners securing the body 711 to the reversed U-type bracket 72 or to any suitable area such as a wall without using the bracket 72. The reversed U-type bracket 72 in FIG. 6B has an attaching element 721 to the body 711 in FIG. 6A, a securing element 725 to one side of toilet water tank, and a bridge 728 for connecting these two elements 721, 725. The attaching element 721 has a multiple holes for securing the reversed U-type bracket 72 to the holder body 71 with fasteners 704 in FIG. 9A. The securing element 725 also has a multiple holes 726 for securing on the topside wall of toilet water tank with fasteners 702 in FIG. 9A. The bridge 728 should establish greater length than the thickness of the wall of the toilet water tank to place over the edge. The holder 70 can be built into a single unit by consolidating the body 71 and the bracket 72 into one piece, reducing costs and simplifying structures.

Figure 7:
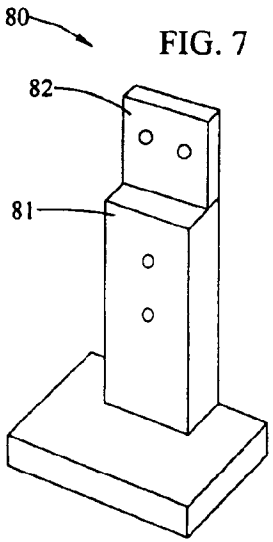
FIG. 7 is a perspective view of the holder for lavatory items comprising a body for placing the lavatory items and a bracket for placing onto topside of water tank using fasteners.
Figure 7A:
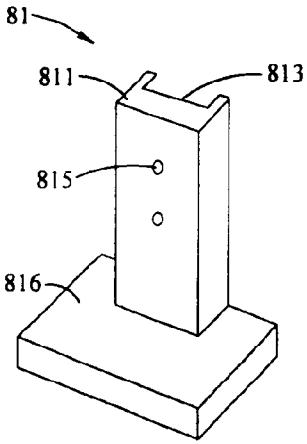
FIG. 7A is a perspective view of the body of the holder for lavatory items.
Figure 7B:
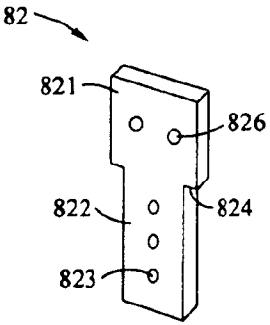
FIG. 7B is a perspective view of an I-type of bracket for the holder.

A holder 80 for lavatory items in FIG. 7 comprises a holder 81 and an I-type bracket 82. The holder body 81 in FIG. 7A has a holder body 811 that contains an opening 813 for the I-type bracket 82, a base plate 816 for placing lavatory items such as a cleansing agent or a bottle of perfume, and holes 815 for fasteners to secure. The holes 815 are located for fasteners securing the holder body 811 to the I-type bracket 82 or to any suitable area such as a wall without using the I-type bracket 82. The I-type bracket 82 in FIG. 7B has an element 821 that is attached to the holder body 811 in FIG. 7A and is secured to the topside wall of toilet water tank with fasteners 802 in FIG. 10A. A multiple holes 823 of the element 821 are using for securing the I-type bracket 82 to the body 81 with fasteners 804 in FIG. 10A. The element 821 also has a multiple holes 826 for securing through the holes 653 in FIG. 8A on the topside wall of toilet water tank with fasteners 802 in FIG. 10A. This holder 80 can also be built into a single unit by consolidating the body 81 and bracket 82 into one piece, reducing costs and simplifying structures. The I-type bracket 82 can be used for the holder body 71 in FIG. 6A for the sprayer, or the reversed U-type bracket 72 can be attached to the holder body 81 in FIG. 7A for lavatory items. These two brackets require distinctive specifications of the toilet water tank and its lid for their own attachment, selectively applied for the best fit either in mixed or in same kind of choice.

Figure 10:
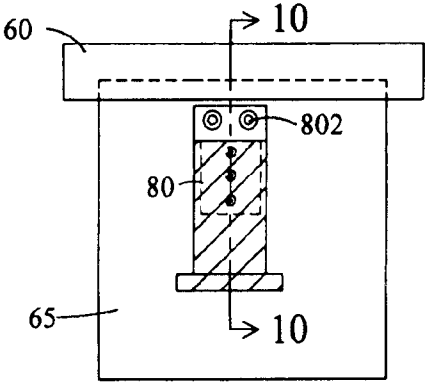
FIG. 10 is a front view of the holder for the lavatory items mounted on the topside of the water tank using fasteners with its lid covered.
Figure 10A:
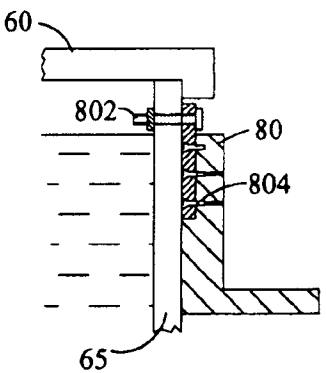
FIG. 10A is a side view taken on the line 10—10 in FIG. 10.
Figure 9:
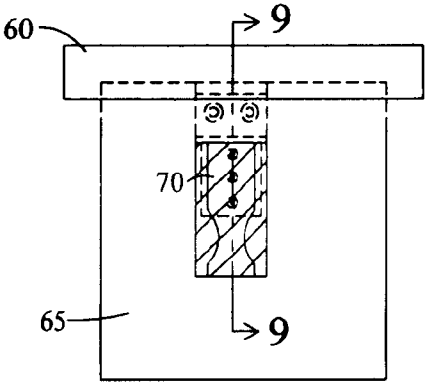
FIG. 9 is a front view of the holder for the sprayer mounted on the top edge of the water tank with its lid covered.
Figure 9A:
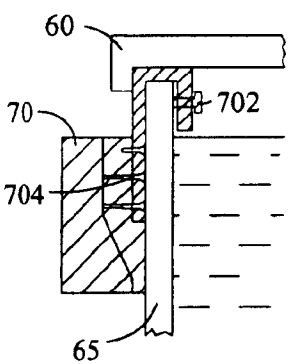
FIG. 9A is a side view taken on the line 9—9 in FIG. 9.
Figure 8:
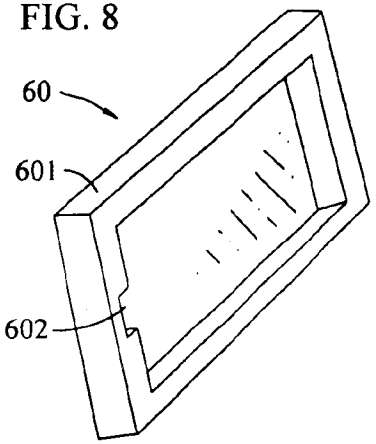
FIG. 8 is a perspective view of the lid for the water tank having a cutout at the edge for flush mounting of a reversed U-type of bracket.
Figure 8A:
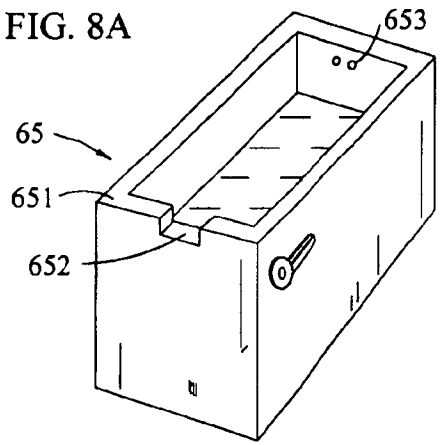
FIG. 8A is a perspective view of the water tank having a cutout at one edge for flush mounting of a reversed U-type of bracket and small openings at topside for mounting of I-type of bracket with fasteners.

An improved toilet water tank lid 60 in FIG. 8 has a body 601 containing a cutout 602 on the edge of inside for the reversed U-type holder. An improved toilet water tank 65 in FIG. 8A also has a body 651 containing a cutout 652 on the top edge for the reversed U-type holder. The cutout offers room for the bracket of holder to be placed over the edge without lifting the toilet water tank lid 60, allowing flush mounting. The size of the cutout is depends on the size of the bracket. The holder 70 in FIG. 9 for the sprayer is flush mounted at the topside edge of the toilet water tank 65 and its lid 60 is flush placed above as shown in FIG. 9A. The holder 80 in FIG. 10 for the lavatory items is mounted at the topside of the toilet water tank 65 with fasteners 802 and its lid is flush placed above as shown in FIG. 10A. The fasteners 702 in FIG. 9A and 802 in FIG. 10A for the holders 70, 80 are secured above the water level in the toilet water tank, avoiding submergence of the components. The brackets and fasteners 702,802 that are made of plastics can reduce chances of corrosion for longer lifetime.

Figure 11A:
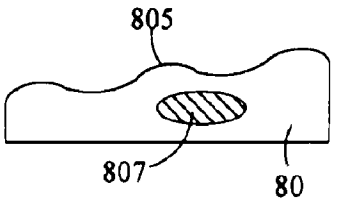
FIG. 11A is a side view of the toilet seat taken by the line 11—11 in FIG. 11, showing location points on the surface and a supporting piece embedded.
Figure 11:
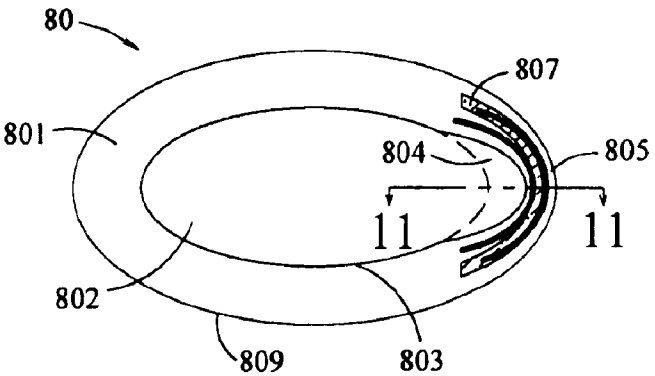
FIG. 11 is a top view of the toilet seat having an extra opening and guidelines at the frontal area with a C-shaped supporting piece embedded.

The conventional toilet seats generally have one closed oval opening. The edge 803 in FIG. 11 of the oval opening 802 shares the same focal point as the outer edge 809, maintaining constant width for seating. Some inventions have wider area in the middle to establish more room for the purpose of comfortable seating. However, an improved toilet seat 80 in this invention provides an additional small opening 804 for the room of easy placement of the sprayer while the user sits on the toilet seat. As shown in FIG. 11, a body 801 of the improved toilet seat 80 contains an additional small opening 804 at the frontal area, adjoined to the existing large oval opening 802 of the conventional toilet seat. The additional small opening 804 is established from the area for seating. Besides, the location points 805 are added around the frontal edge of the additional small opening 804 in FIG. 11, serving as guidelines for easy placement of the sprayer into the toilet bowl. The waveform of these location points 805 as shown in FIG. 11A is located on the surface of the improved toilet seat at frontal area, guiding placement of the sprayer with the support of the location points 1035 in FIG. 2 on the extension bar 103. The additional small opening 804 leaves a narrow width at the frontal area, requiring the fragile frontal area to be fortified. The C-shaped element 807 in FIG. 11 made of strong material is embedded inside the toilet seat as shown in FIG. 11A around the additional small opening 804 to compensate the weakness.

Figure 12A:
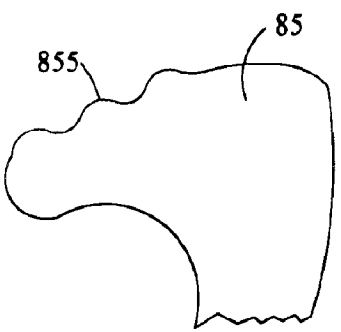
FIG. 12A is a side view of the toilet bowl taken by the line 12—12 in FIG. 12, showing location points on the surface.
Figure 12:
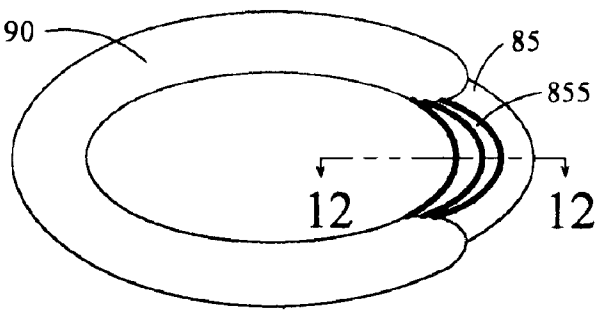
FIG. 12 is a top view of the open-ended toilet seat and a toilet bowl having guidelines of locating points at the frontal area.

Some of the conventional toilet seat has an opened end at the frontal area as shown in FIG. 12. The toilet seat with opened end offers more room for the user at the frontal area and is generally used for the commercial purposes. For this kind of toilet seat, the location points can be placed on the surface of toilet bowl at the frontal area, as shown in FIG. 12. The measured increment of these location points 855 in FIG. 12A on the body of toilet bowl 85 serves as guidelines, facilitating placement of the sprayer with the support of locating points 1035 in FIG. 2 on the extension bar 103. Therefore, the user can place the sprayer into the toilet bowl for a proper position through a sense of insertion depth using guidelines.

What I claimed as my invention is:

1. An improved toilet system attached a multi-purpose hand held sprayer comprises:

a multi-purpose hand held sprayer having a controller with a shut-off valve for regulating the flow of water, an extension bar connected to said controller to supply a single stream of water for cleaning the toilet system and its vicinity, and a spray tip further connected to said extension bar to supply a multiple streams of water through a plug for cleansing a part of the user's body;

a flexible water hose adapted for connecting said multi-purpose hand held sprayer to be extended water supply from the source;

a hose hanger for arrangement of said flexible water hose having means to attach to the existing fasteners for a toilet seat and a toilet water tank;

a valve secured to said flexible water hose for regulating the flow of water;

a Y-adapter assembly to tap water from the existing plumbing fixture;

a holder for placing said sprayer mounted on a top edge of water tank or any other flat surface;

a holder for placing lavatory items mounted on a top side of water tank or any other flat surface;

an improved toilet water tank lid having cutouts on the internal edges for flush mounting of said holders;

an improved toilet water tank having cutouts on the top edges for flush mounting of said holders;

an improved toilet water tank having holes on the top sides for mounting said holders using fasteners above the water level;

an improved toilet seat having an additional small sector of opening at the frontal area adjoining to the existing large opening of conventional toilet seat for facilitating placement of said multi-purpose hand held sprayer into the toilet bowl, lines of location points around said additional small sector of circular opening on the surface of frontal area as guidelines for facilitating placement of said hand held sprayer, and a C-shaped fortifying material imbedded in the frontal narrow area;

an improved toilet bowl having location points on the surface of frontal area as guidelines for facilitating placement of said multi-purpose hand held sprayer.

2. An improved toilet system attached a multi-purpose hand held sprayer according to claim 1 wherein said multi-purpose hand held sprayer has a body taking a slim and lengthy shape for facilitating placement of the sprayer into the toilet bowl while the user sits on the toilet seat.

3. An improved toilet system attached a multi-purpose hand held sprayer according to claim 1 wherein said controller of multi-purpose hand held sprayer has a body containing a contour for higher placement of said sprayer in said holder.

4. An improved toilet system attached a multi-purpose hand held sprayer according to claim 1 wherein said extension bar of multi-purpose hand held sprayer has a body containing a contour for lower placement of said sprayer in said holder.

5. An improved toilet system attached a multi-purpose hand held sprayer according to claim 1 wherein said extension bar of multi-purpose hand held sprayer has a body containing location points aligned on the back as guidelines to facilitate placing the sprayer into the toilet bowl.

6. An improved toilet system attached a multi-purpose hand held sprayer according to claim 1 wherein said flexible hose comprises an inlet to adapt to said valve, an outlet to adapt to said sprayer, and an internal channel connected from said inlet to said outlet.

7. An improved toilet system attached a multi-purpose hand held sprayer according to claim 1 wherein said hose hanger comprises:

a main rod having a lengthy body containing an opening for locking a part of said flexible hose, an opening for loosely placing the rest part of said flexible hose, a lengthy slot for a fastener in various position, an angled extension to get over a protruded edge of the toilet base, a hole for attachment;

a supporting rod having a lengthy body containing a lengthy slot for a fastener in various position to join with said main rod, and an opening for attachment;

a fastener to join said main rod and said supporting rod through lengthy slots.

8. An improved toilet system attached a multi-purpose hand held sprayer according to claim 1 wherein said Y-adapter assembly comprises:

a main body having an inlet with a washer to seal, the first outlet with a washer to seal, the second outlet with a washer to seal, the first internal channel connected from said inlet to said first outlet, the second internal channel connected from said inlet to said second outlet, and said body having an inlet area lengthened enough to get over the obstacles for rotation to attach to the outlet of existing plumbing fixture;

a bushing having an inlet with a washer to seal for connection to said existing outlet of plumbing fixture, an outlet for coupling to said inlet of main body, an internal channel connected from said inlet to said outlet, and a body having means for tightening;

a straight nipple having an inlet for coupling to said first outlet of main body, an outlet for coupling to the existing water supply line leading to the toilet water tank, an internal channel from said inlet to said outlet, and a body having means for tightening;

an angled nipple having an inlet for coupling to said second outlet of main body, an outlet for coupling to said valve to supply water to said sprayer, an internal channel from said inlet to said outlet, a body having means for tightening, and a body angled for connection to said valve.

9. An improved toilet system attached a multi-purpose hand held sprayer according to claim 1 wherein said existing large opening of conventional toilet seat is for communication with toilet bowl for the purpose of conventional toilet usage.

10. An improved toilet system attached a multi-purpose hand held sprayer according to claim 1 wherein said conventional toilet seat comprises an oval shaped body having a large opening in the middle with surrounding seat for sitting on, wherein said surrounding seat includes a closed frontal area.

11. An improved toilet system attached a multi-purpose hand held sprayer according to claim 1 wherein said additional small opening is established from the internal edge of toilet seat around the frontal area.

12. An improved toilet system attached a multi-purpose hand held sprayer according to claim 1 wherein said additional small opening has the minimum width of frontal seat to maximize the additional opening area.

13. An improved toilet system attached a multi-purpose hand held sprayer according to claim 1 wherein said large oval opening is combined by said additional small opening, creating one solid opening.

14. An improved toilet system attached a multi-purpose hand held sprayer according to claim 1 wherein said holder for the sprayer comprises:

a body having a matching contour to said controller body for placing said sprayer;

a reversed U-type bracket having a frontal element to be secured to said body, a rear element to be secured to said internal topside of toilet water tank preferably above the water level, and a bridge connecting said frontal element and said rear element to be placed on the top edge of said toilet water tank;

holes on said body for fasteners to be secured to said bracket or a flat surface;

holes on said bracket for fasteners to be secured to said body and said internal topside of toilet water tank;

fasteners for said holes to attach two components to be secured.

15. An improved toilet system attached a multi-purpose hand held sprayer according to claim 1 wherein said holder for lavatory items comprises:

a body having a base plate for placing said lavatory items and a column attached to said base plate;

an I-type flat bracket having holes for fasteners to be secured to said body, holes for fasteners to be secured to said topside of toilet water tank through said holes on said topside, and a shoulder for alignment with said body;

holes on said body for fasteners to be secured to said bracket or a flat surface;

fasteners for said holes to attach two components to be secured and to be attached.

16. An improved toilet system attached a multi-purpose hand held sprayer according to claim 14 wherein said reversed U-type bracket or claim 12 wherein said I-type flat bracket can be changeably attached to said different bodies to be secured.

17. An improved toilet system attached a multi-purpose hand held sprayer according to claim 14 wherein said reversed U-type bracket or claim 12 wherein said I-type flat bracket can be selective any same type or mixed types according to selective cutouts and holes on the improved toilet water tank and its lid.

* * * * *